US009421987B2

(12) United States Patent
Becher et al.

(10) Patent No.: US 9,421,987 B2
(45) Date of Patent: Aug. 23, 2016

(54) CHASSIS FRAME FOR RAIL VEHICLES

(75) Inventors: Klemens Becher, Hörsching (AT); Thilo Hoffmann, Graz (AT); Peter Hösch, Sankt Josef (AT); Bernhard Kittinger, Graz (AT); Armin Schank, Graz (AT); Michael Sumnitsch, Graz (AT); Martin Teichmann, Graz (AT); Gerhard Weilguni, Graz (AT)

(73) Assignee: SIEMENS AG ÖSTERREICH, Vienna (AT)

( * ) Notice: Subject to any disclaimer, the term of this patent is extended or adjusted under 35 U.S.C. 154(b) by 811 days.

(21) Appl. No.: 13/382,161

(22) PCT Filed: Jul. 14, 2010

(86) PCT No.: PCT/EP2010/060138

§ 371 (c)(1),
(2), (4) Date: Jan. 4, 2012

(87) PCT Pub. No.: WO2011/006927

PCT Pub. Date: Jan. 20, 2011

(65) Prior Publication Data

US 2012/0240813 A1 Sep. 27, 2012

Related U.S. Application Data

(60) Provisional application No. 61/225,940, filed on Jul. 16, 2009.

(51) Int. Cl.
*B61F 5/00* (2006.01)
*B61F 5/52* (2006.01)

(52) U.S. Cl.
CPC ..... *B61F 5/52* (2013.01)

(58) Field of Classification Search
USPC ..... 105/157.1, 175.1, 176, 172, 173, 182.1, 105/206.1, 206.2, 226
See application file for complete search history.

(56) References Cited

U.S. PATENT DOCUMENTS

| | | | | |
|---|---|---|---|---|
| 1,414,916 | A | 5/1922 | Arvid | |
| 3,313,245 | A | 4/1967 | Sundby | |
| 4,353,309 | A * | 10/1982 | Pollard et al. | 105/136 |
| 4,676,173 | A * | 6/1987 | Mielcarek et al. | 105/209 |
| 5,123,358 | A * | 6/1992 | Kemppainen et al. | 105/167 |
| 5,653,177 | A * | 8/1997 | Rimbaud et al. | 105/182.1 |
| 6,250,232 | B1 | 6/2001 | Emmerling | |
| 6,305,297 | B1 * | 10/2001 | Landrot | 105/182.1 |
| 6,338,300 | B1 * | 1/2002 | Landrot | 105/182.1 |
| 6,637,344 | B2 | 10/2003 | Martin | |
| 2010/0011985 | A1 * | 1/2010 | Bieker et al. | 105/206.1 |
| 2012/0240813 | A1 * | 9/2012 | Becher et al. | 105/157.1 |

FOREIGN PATENT DOCUMENTS

| | | |
|---|---|---|
| DE | 479499 C | 7/1929 |
| DE | 4241300 A1 | 6/1994 |
| DE | 4306848 A1 | 9/1994 |

(Continued)

*Primary Examiner* — Jason C Smith

(57) ABSTRACT

A chassis frame for rail vehicles includes two longitudinal beams and at least one transverse beam which is disposed between the longitudinal beams and hinged thereto. The longitudinal beams are designed in a bent shape and extend through a corresponding cutout of the transverse beam.

5 Claims, 4 Drawing Sheets

(56) References Cited

FOREIGN PATENT DOCUMENTS

| | | | |
|---|---|---|---|
| DE | 19731867 | C1 | 10/1998 |
| EP | 0031008 | A1 | 7/1981 |
| EP | 0399345 | A1 | 11/1990 |
| EP | 0409128 | A1 | 1/1991 |
| EP | 0965512 | A1 | 12/1999 |
| EP | 1276653 | B1 | 1/2003 |
| FR | 2529153 | A1 | 12/1983 |
| FR | 2719276 | A1 | 11/1995 |
| RU | 2096216 | C1 | 11/1997 |
| RU | 2203818 | C2 | 5/2003 |
| WO | WO 9011216 | | 10/1990 |
| WO | WO 0179049 | A1 | 10/2001 |
| WO | WO 2009144315 | A1 | 12/2009 |

* cited by examiner

CHASSIS FRAME FOR RAIL VEHICLES

CROSS REFERENCE TO RELATED APPLICATIONS

This application is the U.S. National Stage of International Application No. PCT/EP2010/060138 filed Jul. 14, 2010, and claims the benefit thereof. The International Application claims the benefits of U.S. Provisional Application No. 61/225,940 U.S. filed Jul. 16, 2009. All of the applications are incorporated by reference herein in their entirety.

FIELD OF INVENTION

The invention relates to an undercarriage frame for rail vehicles, wherein the undercarriage frame has two longitudinal members and, arranged therebetween, at least one transverse member which is connected in an articulated manner to the longitudinal members.

BACKGROUND OF INVENTION

By means of the articulated connection of longitudinal member and transverse member of an undercarriage frame it is possible to achieve an improvement in respect of the risk of derailment compared with rigid undercarriage frames.

An undercarriage of said type having an H-shaped, deformable frame, consisting of two longitudinal members and one transverse member, is described in DE 43 06 848 A1 and in EP 0 409 128 A1. In the arrangement proposed therein shearing forces are introduced into the undercarriage frame by way of wheelset bearings which are rigidly connected to the longitudinal members.

WO 90/11216 discloses an undercarriage with articulated frame having at least one transverse member which is arranged between two longitudinal members and spring-mounted to cushion against the longitudinal members. In this case, too, occurring shearing forces which may be caused by steering actions are introduced by way of wheelset bearings which are rigidly connected to the longitudinal members.

In the undercarriages that have just been cited, shearing forces, such as may occur for example when curves are negotiated, are introduced into the undercarriage frame by way of wheelset bearings which are connected to the longitudinal members of the undercarriage frame, which means that the undercarriage frame should be as resistant to deformation as possible with respect to said shearing forces in order to ensure stable running.

A disadvantageous aspect of said embodiment variants is that the desired resistance to shearing forces between the wheelsets cannot be achieved therewith.

A deformation-resistant undercarriage frame is known from EP 1276653 B1 in which the wheelset bearings are connected to the transverse member or, as the case may be, to one of the transverse members of the rail vehicle in each case.

As a result the shearing forces occurring are introduced by way of the wheelset bearings directly into the respective transverse member. Since the transverse member has a much higher shear resistance with respect to the occurring lateral loads than the longitudinal members, the stiffness properties of the undercarriage and consequently the stable running characteristics are substantially improved thereby.

SUMMARY OF INVENTION

An object of the claimed invention is to develop said known undercarriage frame further.

This object is achieved by an undercarriage frame in which the longitudinal members are implemented in a curved shape and project through a corresponding recess of the transverse member.

In this way significant structural restrictions in the case of undercarriage frames known from the prior art can be overcome.

Thus, in the undercarriage frame known from EP 1276653 B1, the two longitudinal members are arranged over the transverse member and in addition over the primary springs so that the primary springs will not introduce any torsional moment into the longitudinal member. Accordingly, the lateral distance of the two longitudinal members from each other is determined by the track width.

In the known undercarriage frame, the secondary spring is arranged on the transverse member next to the longitudinal member at the outside of the vehicle. As a result the maximum installation space for the secondary spring is limited in the lateral direction by the longitudinal member toward the inside and the given vehicle loading gauge toward the outside.

When the undercarriage rotates outward relative to the railcar body in curve radii, the secondary spring must be able to complete a corresponding lateral travel. The diameter of the secondary spring becomes greater as the lateral travel increases.

With narrow structure clearances (possibly in combination with small curve radii), the above-described installation space is no longer sufficient for installing a suitable secondary spring with a commensurately large diameter.

In the case of the solution according to the invention, on the other hand, the position of the secondary springs seated on the transverse member is laterally variable. In particular the secondary springs can also be arranged partially or entirely over the longitudinal member.

It is furthermore advantageous if the connecting elements between longitudinal member and transverse member are implemented as a further spring stage.

Another advantageous embodiment variant is obtained if the connecting elements between longitudinal member and transverse member are implemented in such a way that they absorb driving or braking torques and are able to limit the pitch angle of the traction motors and of the transverse member.

BRIEF DESCRIPTION OF THE DRAWINGS

The invention is explained in more detail with reference to exemplary embodiments shown in the figures, in which.

DETAILED DESCRIPTION OF INVENTION

Figure 1:
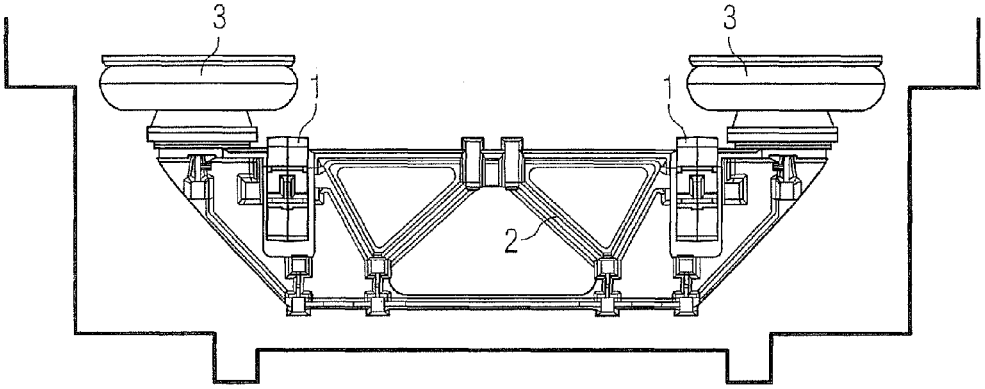
FIG. 1 shows a front view of a first embodiment of the invention.
Figure 2:
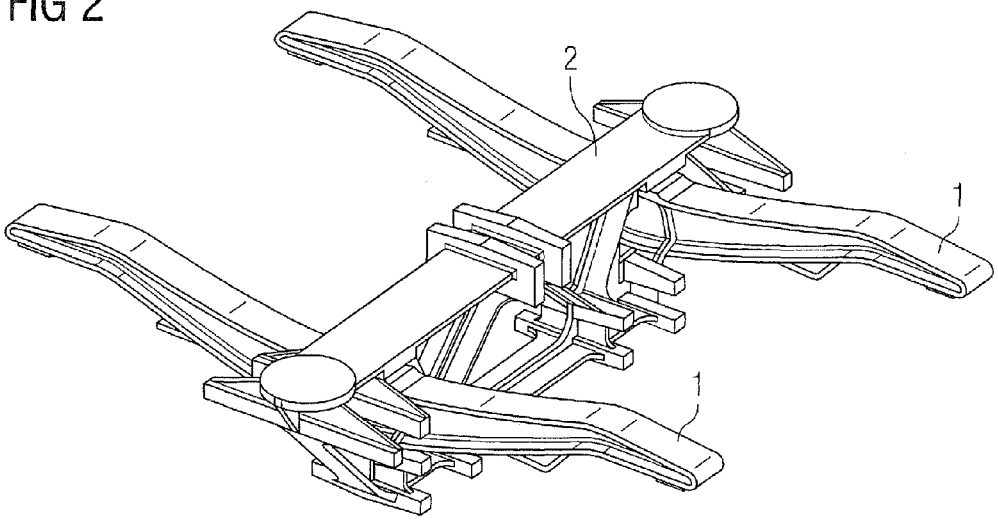
FIG. 2 shows a perspective view of a first embodiment of the invention.

The undercarriage frame depicted schematically in FIGS. 1 and 2 comprises two longitudinal members 1 and one transverse member 2. The two longitudinal members are implemented in a curved shape and penetrate the transverse member through a recess provided for that purpose. The transverse member 2 is seated on the longitudinal members 3 by way of connecting elements 4.

Said connecting elements 4 can be implemented as spring-loaded elements, for example as compression-resistant rubber elements.

There is thus established a movable connection between longitudinal member and transverse member 2, such that the longitudinal members 1 can adjust to the deformation of the track for example when curves are negotiated, as a result of which the risk of derailment can be reduced by comparison with rigid undercarriage frames.

The embodiment according to the invention accordingly provides considerable latitude in relation to the arrangement and dimensioning of the secondary spring 3. Thus, for example, said spring can also be arranged over the longitudinal members 1. In this way the flexural stress can be reduced for the transverse members by means of the secondary springs.

In the exemplary embodiment shown in FIG. 1 and FIG. 2, the transverse member 2 is implemented as a frame having cross struts. This enables the weight of said transverse member 2 to be kept low.

Figure 3:
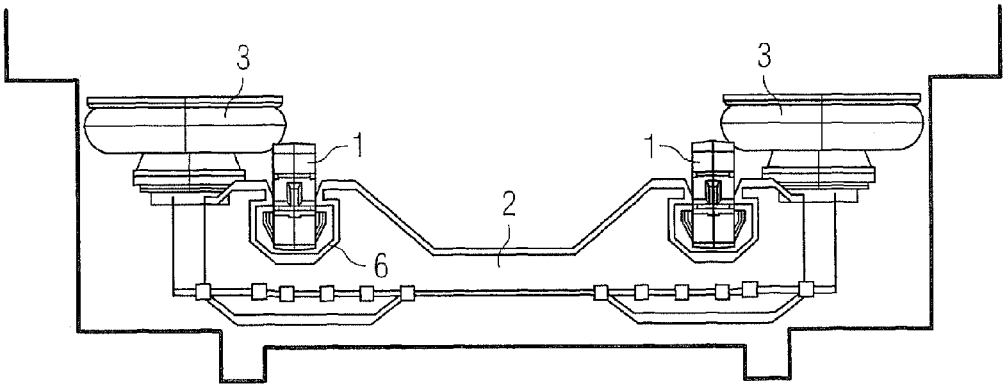
FIG. 3 shows a front view of a second embodiment of the invention.
Figure 4:
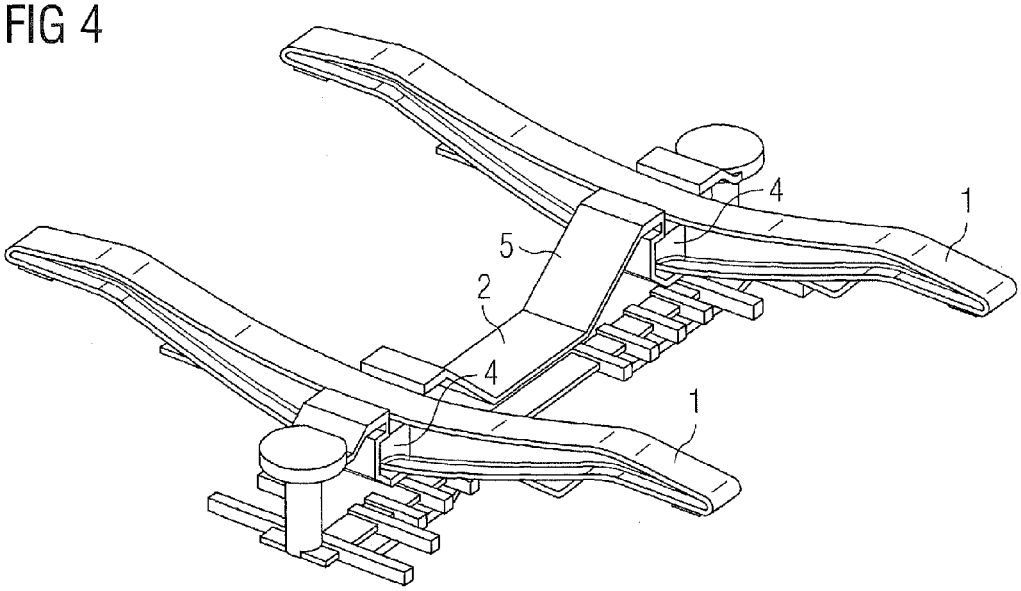
FIG. 4 shows a perspective view of a second embodiment of the invention.
Figure 5:
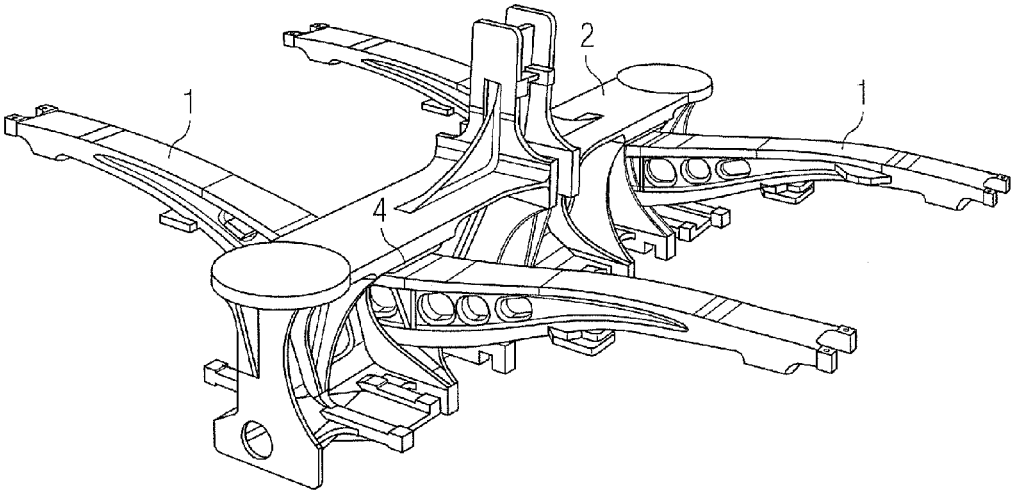
FIG. 5 shows a perspective view of a third embodiment of the invention.

However, the invention can also be used without restrictions in the case of transverse members 2 such as those on which the exemplary embodiment illustrated in FIGS. 3 and 4 is based.

In this case the transverse member 2 is built from a transverse member frame 5 which also has the recesses 6 provided for accommodating the longitudinal members 1. Said frame is reinforced on the inside by means of a plate.

Preferably said recesses 6 can be configured in a mushroom shape so that the longitudinal members 1 are secured against lifting off.

Figure 6:
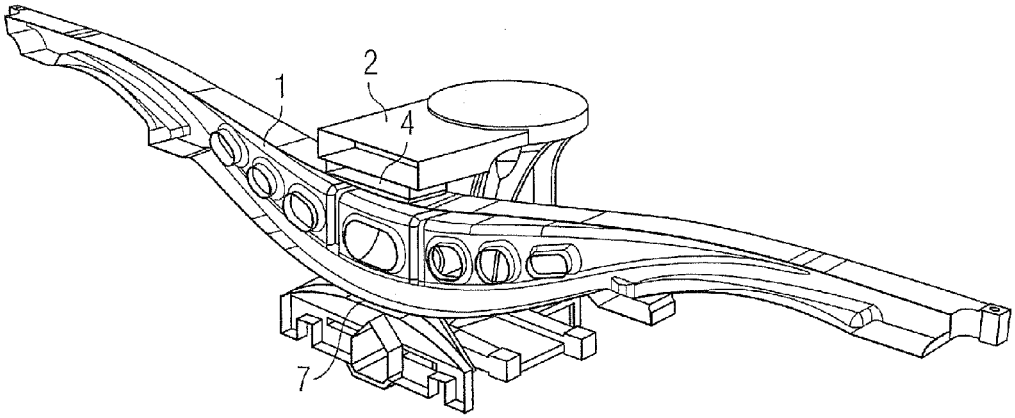
FIG. 6 shows a sectional view of the third embodiment of the invention, the section being taken through a longitudinal member in the direction of travel.

In a third embodiment variant, as shown in FIGS. 5 to 8, this safeguard against lifting off is realized in that the recess 6 is implemented as a closed opening. As shown in FIG. 6, the bearing surface 7 in said recess can be implemented as convex, such that on the one hand the necessary freedom of movement is given for the longitudinal member 1 and on the other hand a lifting-off is prevented.

Figure 7:
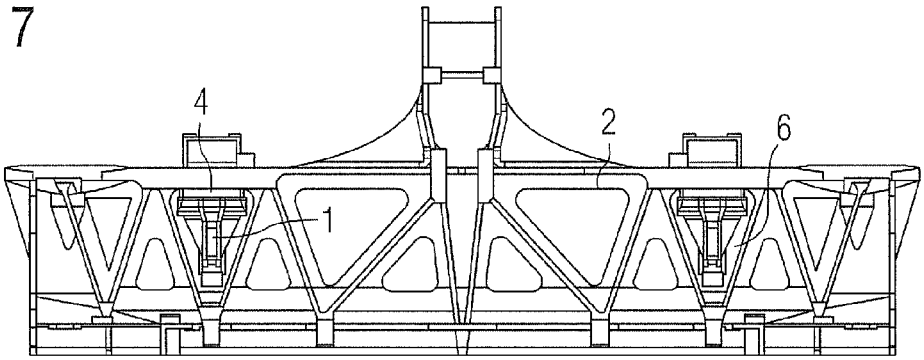
FIG. 7 shows a front view of the third embodiment of the invention.

For reasons of strength the recess is implemented, as shown in FIG. 7, in a triangular shape.

Figure 8:
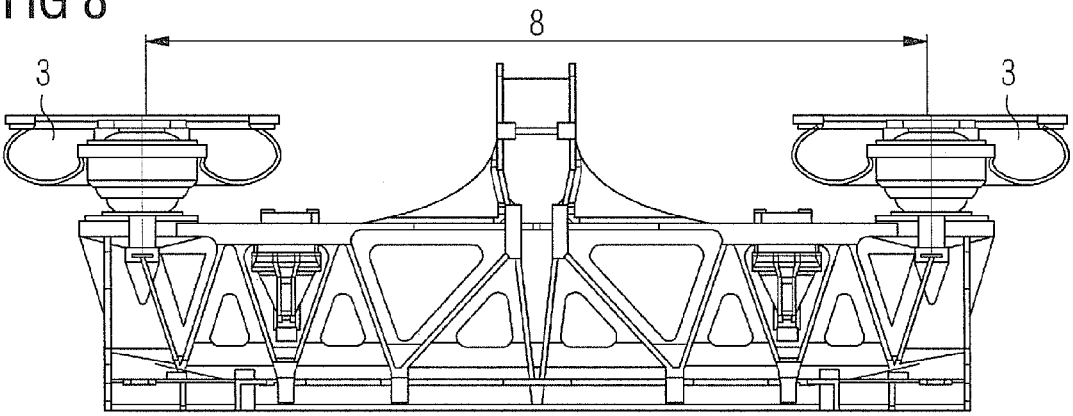
FIG. 8 shows a front view of the third embodiment of the invention with a first variant of the arrangement of the secondary springs.
Figure 9:
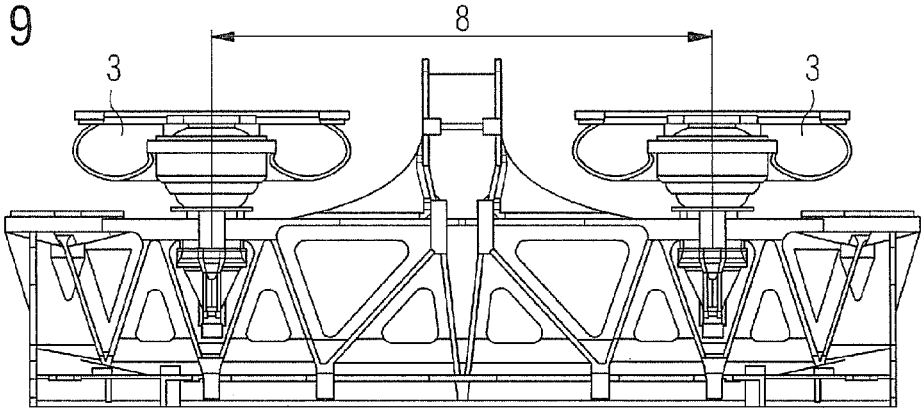
FIG. 9 shows a front view of the third embodiment of the invention with a second variant of the arrangement of the secondary springs.

The views according to FIG. 8 and FIG. 9 show the design freedom made possible by means of the invention in relation to the position of the secondary springs 3. The distance 8 between the bases of the two secondary springs 3 can be freely chosen within wide limits, since the structural restrictions imposed as a result of the longitudinal members 1 being located on top according to the prior art cease to apply.

The invention claimed is:

1. An undercarriage frame for rail vehicles, comprising:
- two longitudinal members, and
- a transverse member arranged between the two longitudinal members,
- wherein the transverse member is connected to the longitudinal members in an articulated manner, and
- wherein the longitudinal members are implemented in a curved shape and project through a recess of the transverse member.

2. The undercarriage frame as claimed in claim 1, further comprising:
- connecting elements arranged between the longitudinal members and the transverse member, wherein the connecting elements are implemented as a spring stage.

3. The undercarriage frame as claimed in claim 2, wherein the connecting elements between the longitudinal members and the transverse member are implemented such that they
- absorb driving or braking torques, and
- limit a pitch angle of traction motors and of the transverse member.

4. The undercarriage frame as claimed in claim 1, further comprising:
- secondary springs arranged at least partially over the longitudinal members.

5. The undercarriage frame as claimed in claim 1, wherein a lifting-off of the longitudinal members from the connecting elements is prevented by a particular geometric shape of the recess of the transverse member.

* * * * *